US006106326A

United States Patent [19]

Schramme

[11] Patent Number: 6,106,326

[45] Date of Patent: Aug. 22, 2000

[54] ELECTRICAL CONNECTOR WITH CONTACT RETAINING MODULE FORMED FROM REVERSE ALTERNATING MODULAR FRAME PIECES

[75] Inventor: Stephan H. Schramme, Farmington Hills, Mich.

[73] Assignee: Framatome Connectors Interlock, Inc., Westland, Mich.

[21] Appl. No.: 09/085,510

[22] Filed: May 27, 1998

[51] Int. Cl.[7] ..... H01R 13/58

[52] U.S. Cl. ..... 439/460; 439/717

[58] Field of Search ..... 439/460, 461, 439/723, 724, 712, 714, 715, 716, 717, 718, 721, 722, 225

[56] References Cited

U.S. PATENT DOCUMENTS

| | | | |
|---|---|---|---|
| 2,441,393 | 5/1948 | Buchanan et al. | 439/712 |
| 3,854,790 | 12/1974 | Provinsky | 439/460 |
| 4,033,658 | 7/1977 | Asick | 439/218 |
| 4,719,321 | 1/1988 | Kozel et al. | 174/135 |
| 4,983,132 | 1/1991 | Weidler | 439/786 |
| 5,288,251 | 2/1994 | Sumida | 439/701 |
| 5,380,226 | 1/1995 | Anderson | 439/724 |
| 5,830,002 | 11/1998 | Ito et al. | 439/358 |
| 5,857,259 | 1/1999 | Johnston | 29/858 |

*Primary Examiner*—Paula Bradley
*Assistant Examiner*—Ross Gushi
*Attorney, Agent, or Firm*—Perman & Green, LLP

[57] ABSTRACT

An electrical connector housing is formed with a retaining module for retaining electrical conductors with the housing. The retaining module is comprised of modular frame pieces having the same shape, but alternatingly reversely orientated in a row. Electrical conductors are sandwiched in grooves between adjacent frame pieces. The frame pieces are ultrasonically welded together. The housing also has two lock modules with snap-lock rocker arms. The lock modules are ultrasonically welded to the frame pieces.

18 Claims, 5 Drawing Sheets

ELECTRICAL CONNECTOR WITH CONTACT RETAINING MODULE FORMED FROM REVERSE ALTERNATING MODULAR FRAME PIECES

BACKGROUND OF THE INVENTION

1. Field of the Invention

The present invention relates to electrical connectors and, more particularly, to a retaining module used in a housing of an electrical connector.

2. Prior Art

U.S. Pat. No. 5,380,226 discloses frame pieces of an electrical connector that are ultrasonically welded together.

SUMMARY OF THE INVENTION

In accordance with one embodiment of the present invention, an electrical connector is provided comprising electrical conductors and a frame. The frame surrounds and holds portions of the electrical conductors in a fixed array. The frame is comprised of at least three sandwiching members having a same non-uniform shape. The sandwiching members are connected to each other in a row and are alternatingly reversely positioned along the row. The electrical conductors are sandwiched between the sandwiching members to fixedly hold the portions of the electrical conductors.

In accordance with another embodiment of the present invention, an electrical connector housing modular frame piece is provided. A top side of the frame piece has conductor receiving grooves, an alignment projection at a first lateral side, and an alignment pole at a second lateral side. A bottom side of the frame piece has conductor receiving grooves, an alignment projection at the first lateral side and an alignment hole at the second lateral side. The two alignment holes are aligned with each other and the two alignment projections are aligned with each other. The frame piece is suitably sized and shaped such that three of the frame pieces can be connected to each other in a stack in alternating reversely orientated positions with the alignment projection being received in the alignment holes of adjacent frame pieces.

In accordance with one method of the present invention, a method of assemblying an electrical connector is provided comprising steps of providing a plurality of modular frame pieces and connecting at least three of the modular frame pieces to each other in a stack. Each frame piece has conductor receiving grooves on top and bottom surfaces of the frame piece, a hole through the frame piece between the top and bottom surfaces at a first lateral side, and two projections from the top and bottom surfaces at a second opposite lateral side. The step of connecting the frame pieces to each other in a stack is accomplished with the electrical conductors being positioned and located in the conductor receiving grooves of adjacent modular frame pieces. The modular frame pieces are alternatingly reversely orientated and sonically welded together.

BRIEF DESCRIPTION OF THE DRAWINGS

The foregoing aspects and other features of the present invention are explained in the following description, taken in connection with the accompanying drawings, wherein.

DETAILED DESCRIPTION OF THE PREFERRED EMBODIMENT

Figure 1:
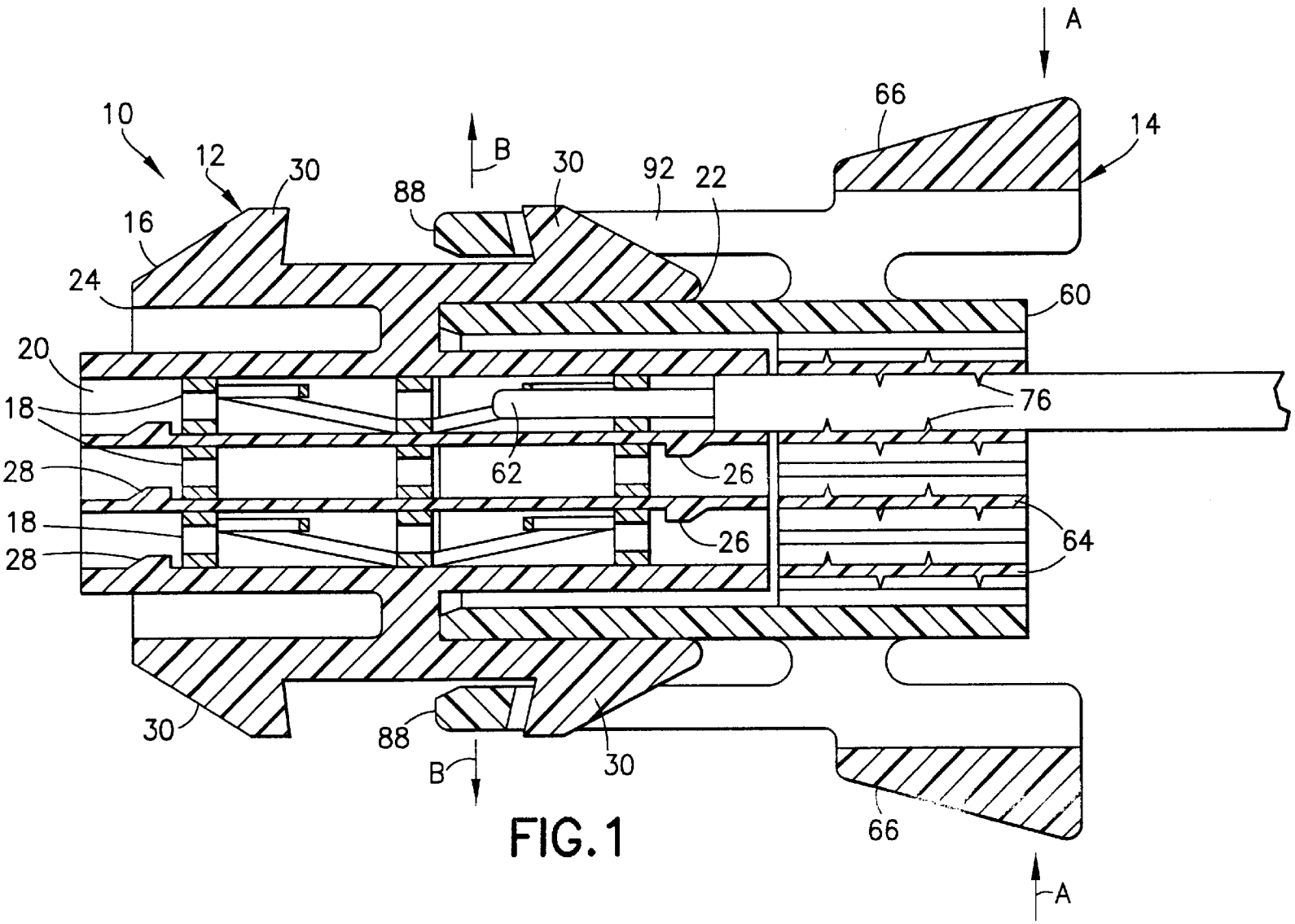
FIG. 1 is a cross-sectional view of an electrical connector incorporating features of the present invention shown mated to a mating electrical connector.

Referring to FIG. 1, there is shown an exploded perspective view of an electrical connector assembly 10 incorporating features of the present invention. Although the present invention will be described with reference to the embodiments shown in the drawings, it should be understood that the present invention can be embodied in many alternate forms of embodiments. In addition, any suitable size, shape or type of elements or materials could be used.

Figure 2:
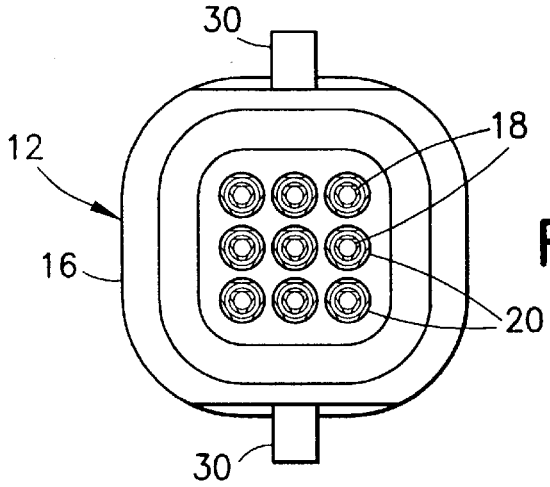
FIG. 2 is a front elevational view of the female electrical connector shown in FIG. 1.

The assembly 10 includes a female electrical connector 12 and a mating male electrical connector 14. The female connector 12 includes a one-piece dielectric housing 16 and a plurality of electrical contacts 18. Referring also to FIG. 2, a front end view of the female connector 12 is shown. In this embodiment the housing 16 has an array of nine (3×3) contact receiving holes 20. However, in alternate embodiments any suitable number or array could be provided. The holes 20 extend entirely through the housing between the two opposite ends 22, 24. Each hole 20 has two radially inwardly extending lock tabs 26, 28; a single one of the tabs at each end of each hole. The housing 16 also has four snap-lock tabs 30; two on a top side and-two on a bottom side.

Figure 3A:
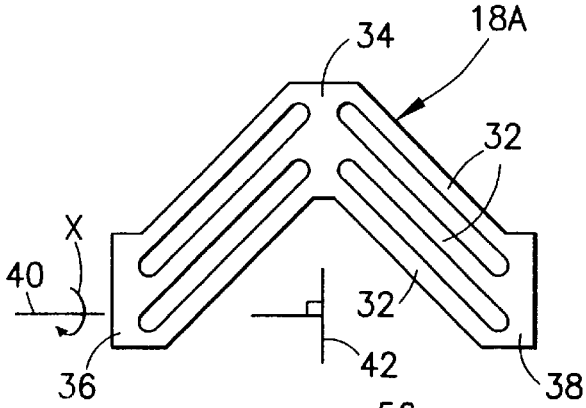
FIG. 3A is a top plan view of a contact blank used in the connector shown in FIG. 2.
Figure 3B:
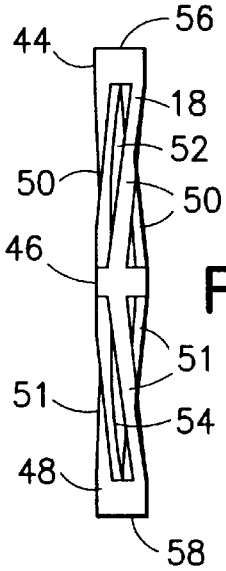
FIG. 3B is a top plan view of the contact blank of FIG. 3A bent into the dual female contact used in the female electrical connector.
Figure 3C:
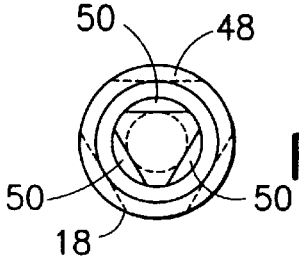
FIG. 3C is an end view of the contact shown in FIG. 3B.

Referring also to FIG. 3A, the female electrical contacts are made from a flat sheet metal blank 18A that is subsequently bent or rolled into a column or tub shape as shown in FIG. 3B. The blank 18A, in this embodiment, comprises three parallel V-shaped sections 32 that are connected at their vertices by a center connection section 34 and are connected at their ends by end connection sections 36, 38. In alternate embodiments more than three V-shaped sections could be provided. In addition, the parallel sections 32 need not have a V-shape, but preferably have mirror shapes on opposite sides of the center connection section 34. In order to form the contact 18, the blank 18A is bent or rolled along axis 40. The axis 40 is generally orthogonal to the center symmetrical axis 42 of the blank 18A; along the center connection section 34. When the bending is completed, the contact 18 is formed with three general ring shaped sections 44, 46, 48 interconnected by two sets of three twisted beam sections 50, 51, on each side of the center ring section 46. The beam sections 50, 51, because of their twisted shape, form a narrowed contact receiving area which is smaller than the areas through the ring shaped sections. The contact 18 forms two receiving areas 52, 54, on opposite sides of the center ring shaped section 46 for receiving two male contacts separately through the opposite ends 56, 58. Preferably, the beams 50, 51 in each receiving area 52, 54, are symmetrically arranged such that there is symmetrical contact with an inserted male contact. Because the center ring shaped section 46 separates the two sets of beam sections 50, 51, the two sets of beam sections are able to substantially independently and separately mechanically function for contacting male contacts. When the contacts 18 are inserted into the holes 20, the front ring sections on the lock tabs 28 help to guide the contacts over the lock tab (resiliently deforming slightly) and then are entrapped between the two tabs 26, 28. Because only one lock tab is provided at each end of each hole 20, this allows the housing 16 to be molded as a one-piece member and the contacts 18 subsequently inserted; the lock tabs 26, 28 allowing the contacts 18 to be inserted into the holes with a small amount of resilient deformation, but nonetheless being captured between the tabs 26, 28. In an alternate embodiment, the housing 16 could be comprised of multiple pieces.

The female connector 12 is intended to be used to connect the male connector 14 (or any other suitable connector) to another component, such as another male connector or a pin header. In particular, one component is electrically connected to the receiving areas 52 of the contacts 18 and the other component is electrically connected to the receiving areas 54. Thus, a male contact-to-contact connection can be provided by the dual female contacts 18 which avoids crimping or soldering. Wires could also be connected to the female contacts 18 individually without a male connector housing. Separate end caps (not shown) with full radial interference retain the contacts 8 in the housing 16 could also be provided on the female housing.

Figure 4:
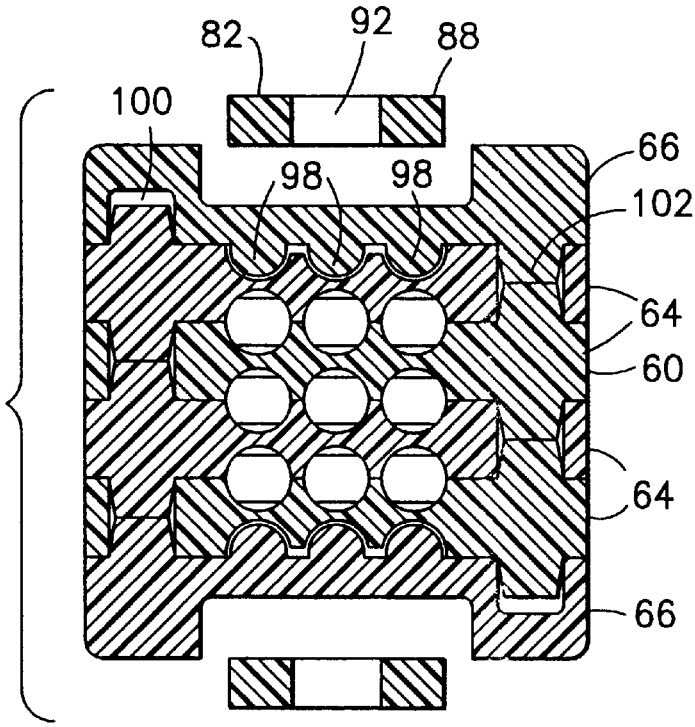
FIG. 4 is a cross-sectional view of the housing of the mating male electrical connector shown in FIG. 1.
Figure 5:
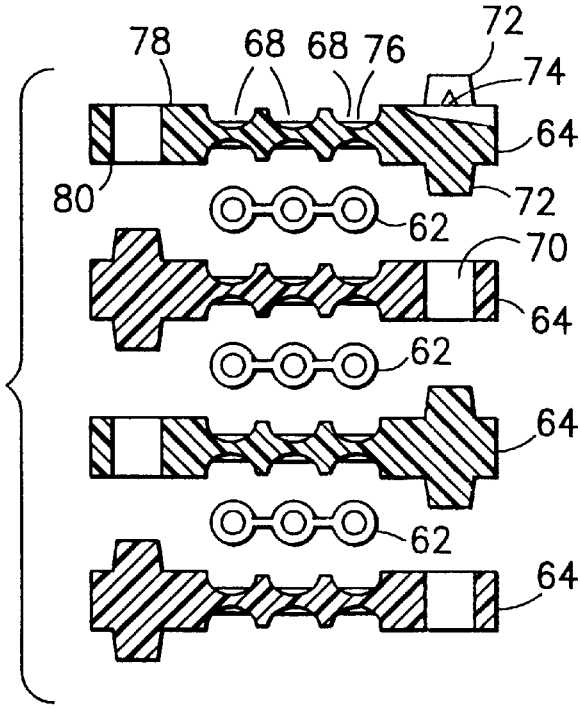
FIG. 5 is a partial exploded cross-sectional view of frame pieces and electrical conductors that form part of the mating male electrical connector shown in FIG. 1.
Figure 6:
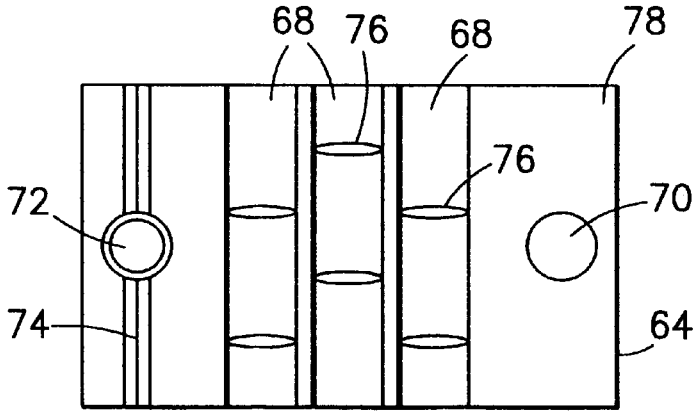
FIG. 6 is a top plan view of one of the frame pieces shown in FIG. 5.

Referring now to FIGS. 1 and 4, the mating male electrical connector 14 generally comprises a housing 60 and conductors 62 (only one of which is shown in FIG. 1 for the sake of clarity). FIG. 4 merely shows a cross-section of the housing 60 without showing the conductors, also for the sake of clarity. The housing 60 generally comprises a plurality of modular frame pieces or sandwiching members 64 and lock modules 66. Referring also to FIGS. 5 and 6, each frame piece 64 is comprised of dielectric molded plastic material and they all have a same non-uniform shape. In particular, each frame piece 64 has conductor receiving grooves 68, an alignment through hole 70, locking alignment projections 72, energy directors 74, and cable retention ribs 76. In this embodiment each frame piece 64 has six parallel conductor receiving grooves 68; three on a top side 78 and three on a bottom side 80. The top and bottom sides 78,80 have holes proximate a first lateral side of the frame piece that combine to form the alignment through hole 70. The top and bottom sides 78, 80 also have the two locking alignment projections 72 extending therefrom in opposite directions proximate a second opposite lateral side of the frame piece. The projections 72 have a general tapered column shape. The cable retention ribs 76 extend across the grooves 68.

In this embodiment four of the frame pieces 64 are provided. However, in alternate embodiments, more or less than four frame pieces could be used. The frame pieces 64 are assembled in a row or stack in alternating reversely orientated positions. The locking alignment projections 72 of each frame piece 64 are located in the alignment through hole 70 of adjacent frame pieces. The grooves 68 on adjacent frame pieces align and form channels that sandwich portions of the electrical conductors 62 therebetween. In this embodiment the conductors 62 comprise flat cable assemblies with wires covered by insulation. However, in alternate embodiments single insulated wire conductors could be provided in each channel. The energy directors 74 are provided to initiate and propagate ultrasonic welding. The cable retention ribs 76 project into the conductor insulation to fixedly hold the flat cable assemblies between the frame pieces 64.

Figure 7:
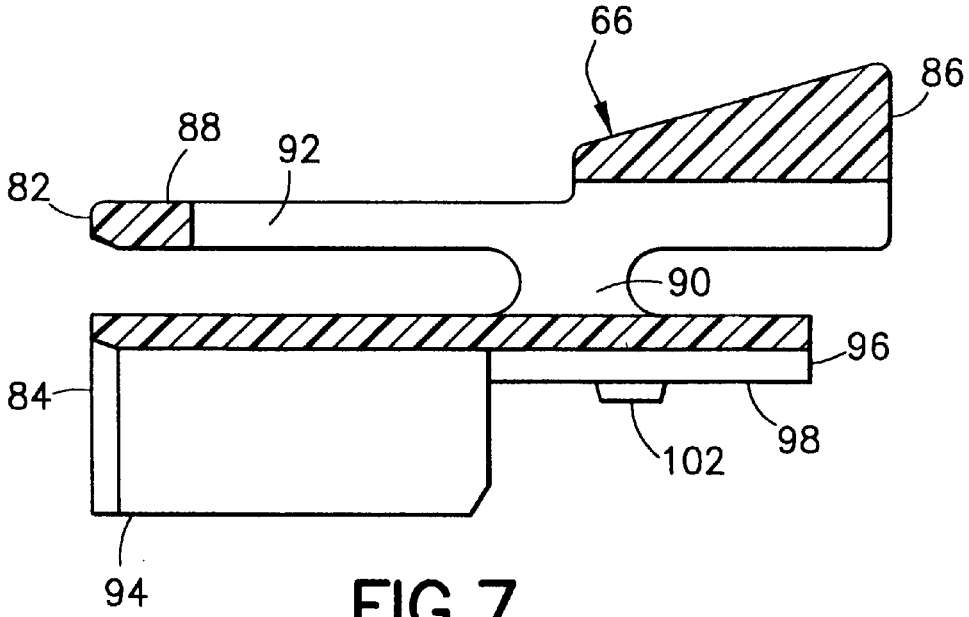
FIG. 7 is a cross-sectional view of one of the lock modules used on the housing of the male electrical connector shown in FIG. 1.

The lock modules 66 are also one-piece dielectric molded plastic members. In this embodiment the connector 14 has two of the lock modules 66. However, in alternate embodiments one or no lock modules could be used. In this embodiment both lock modules 66 are the same. However, in alternate embodiments they could be different and have polarizing means for proper connection with the female connector housing. The lock modules 66 could also be replaced by a one-piece housing piece with connector locking and polarizing features; wherein a preassembly of frame pieces 64 and conductors 62 are snap-lock inserted into the housing piece. This would require a unique lock module for each contact configuration, but would provide keying, a stronger lock, and would allow normally incomparable materials to be used to optimize weld strength consistency and lock function. Referring also to FIG. 7, each lock module 66 comprises a latching rocker arm 82 and a shell section 84. The rocker arm 82 has a finger contact section 86, a snap-lock latching section 88, and a resilient bending section 90 which connects the arm 82 to the shell section 84. The snap-lock latching section 88 has a hole 92 for receiving one of the snap-lock tabs 30 of the female connectors (see FIGS. 1 and 4). The finger contact sections 86 can be depressed as indicated by arrows A in FIG. 1 to move the latching sections 88 out of latching engagement with the tabs 30 as indicated by arrows B. The bending section 90 allows the arm 82 to pivot or rock relative to the shell section 84. The shell section 84 has a front half-shroud section 94 and a rear connection section 96. The two half-shroud section 94 of the two lock modules 66 combine to enclose the front ends of the conductors in a pocket intended to receive part of the female connector housing 16. The rear connection section 96, as seen best in FIG. 4, comprises groove interlock projections 98, an alignment hole 100, and an alignment projection 102. The hole 100 receives that projection 72 of an adjacent frame piece 64. The projection 102 extends into the hole 70 of the adjacent frame piece 64. The groove interlock projections 98 extend into the grooves 68 of the adjacent frame piece. Preferably, the frame pieces 64 and lock modules 66 are all ultrasonically welded together to form a unitary structure with the conductors 62 fixedly sandwiched inside the housing 60. In alternate embodiments additional or alternative fixation means could be used.

Figure 8:
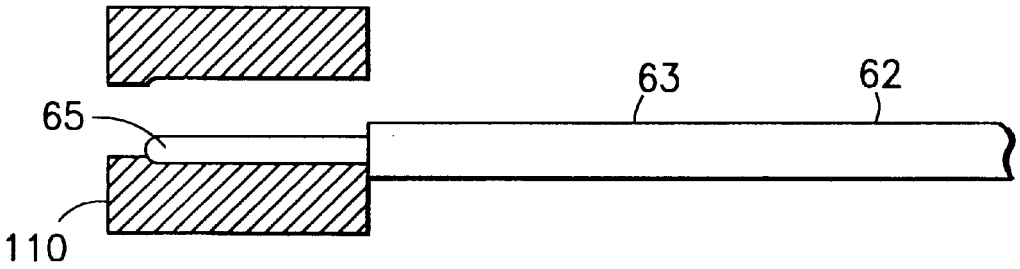
FIG. 8 is a schematic view of a process used to solidify and form a conductor core into a contact pin.

Referring also to FIG. 8, prior to connection of the housing to the conductors, the leading end of the conductors 62 have a portion of the insulation 63 removed to expose the leading end of the wire 65. A solidifying die set 110 is then used to solidify the strands of each wire 65 together to form a contact pin section for insertion into one end of the dual female contacts 18. In other words, the leading end of the wires (that extend past the sandwiching members 64) are formed into male contact pin sections for insertion into a mating electrical connector. In alternate embodiments other contact pin forming or solidifying means could be used. Alternatively, a contact pin could be attached to the leading ends of the wires 65.

Figure 9:
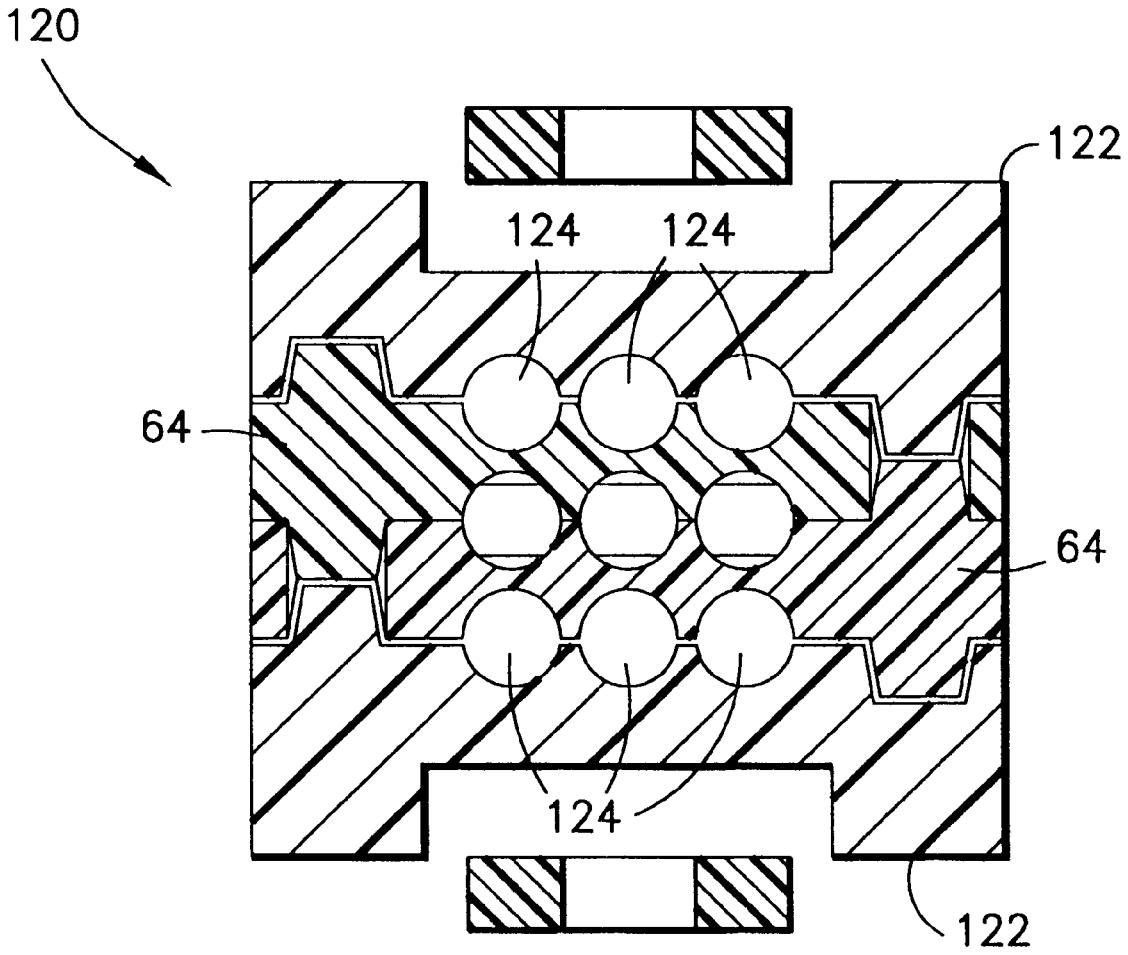
FIG. 9 is a cross-sectional view of another embodiment of the male connector housing.

Referring now to FIG. 9, an alternate embodiment of the male connector housing 120 is shown. In this embodiment only two of the frame pieces 64 are used. However, the lock modules 122 have conductor receiving grooves 124 rather than the groove interlock projections 98 shown in lock modules 66 of FIG. 4. Thus, even though only two frame pieces 64 are used, three rows of conductor receiving channels are provided; two of the rows being established between the lock modules 122 and the frame pieces 64.

The invention as described above can be used to provide the following features:

1.27 mm center-to-center contact positioning in both mating axes.

Modular construction allows multiple rows to be stacked. The same cable retainer module is used between each row of cable by alternating its orientation.

Only one lock module part number is needed to complete the cable retainer module assembly, used at both the top and bottom for uniform retention.

The modules are designed to be sonically welded, with the welding process control criteria being the finished height.

The number of rows and the number of contacts per row are limited only by the capability of the welding process.

Male pin is formed by solidifying the cable core. Minimizes the number of contact points.

BeCu female receptacle contact accepts one male pin from each end with three semi independent beams for each pin. Calculated normal force is 140 g at 0.13 mm deflection.

The female receptacle can be used to accept either:

1. Two cable retainer modules for an in-line configuration or
2. One cable retainer module and one pin header for PC board applications.

Can be used with either round conductor flat cable or discreet wire.

Pump handle lock allows ease of mating and unmating.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. An electrical connector comprising:

a plurality of electrical conductors; and a frame surrounding and holding portions of the electrical conductors in a fixed array, the frame being comprised of at least two sandwiching members having a same shape, each sandwiching member having opposite lateral ends with different shapes, wherein the sandwiching members are connected to each other in a row and alternatingly reversely positioned along the row, wherein the electrical conductors extend through the sandwiching members and are sandwiched between the sandwiching members to fixedly hold the portions of the electrical conductors, wherein at least one of the sandwiching members comprises conductor receiving grooves on both top and bottom surfaces.

2. A connector as in claim 1 wherein the electrical conductors are located in flat cable assemblies which are sandwiched between the sandwiching members.

3. A connector as in claim 1 wherein the electrical conductors are wires covered by insulation which have a leading end of the wires that extend past the sandwiching members and are formed into male contact pin sections for insertion into a mating electrical connector.

4. A connector as in claim 1 wherein each sandwiching member comprises a through-hole at one of the lateral ends extending between the top and bottom surfaces and locking projections extending from the top and bottom surfaces at another one of the lateral ends.

5. A connector as in claim 1 wherein the grooves comprise cable retention ribs thereacross.

6. A connector as in claim 1 wherein the sandwiching members are ultrasonically welded together.

7. A connector as in claim 1 wherein the frame further comprises two lock modules fixedly connected to the sandwiching members.

8. A connector as in claim 7 wherein the lock modules have a same size and shape with a latching rocker arm having a finger contact section and a snap-lock latching section.

9. An electrical connector housing modular frame piece comprising:

a top side having conductor receiving grooves, an alignment projection at a first lateral side and an alignment hole at a second lateral side;

a bottom side having conductor receiving grooves, an alignment projection at the first lateral side and an alignment hole at the second lateral side, wherein the two alignment holes are aligned with each other and the two alignment projections are aligned with each other such that a plurality of the frame pieces can be connected to each other in a stack in alternating reversely orientated positions with the alignment projections being received in the alignment holes of adjacent frame pieces.

10. A modular frame piece as in claim 9 wherein the grooves on the top and bottom sides have cable retention ribs extending thereacross.

11. A modular frame piece as in claim 9 wherein the alignment holes form a single through-hole between the top and bottom sides.

12. A modular frame piece as in claim 9 wherein the top and bottom sides further comprise energy directors.

13. A modular frame piece as in claim 9 wherein the alignment projections have a general tapered column shape.

14. A method of assembling an electrical connector comprising steps of:

providing a plurality of modular frame pieces, each frame piece having conductor receiving grooves on top and bottom surfaces of the frame piece, a hole through the frame piece between the top and bottom surfaces at a first lateral side, and two projections from the top and bottom surfaces at a second opposite lateral side;

connecting at least two of the modular frame pieces to each other in a stack with electrical conductors being positioned and located in the conductor receiving grooves of adjacent modular frame pieces, the modular frame pieces being alternatingly reversely orientated and sonically welded together.

15. A method as in claim 14 further comprising connecting two locking modules to the modular frame pieces, each locking module having a snap-lock latching rocker arm with a finger contact section.

16. A method as in claim 15 wherein the step of connecting the two locking modules to the modular frame pieces comprises ultrasonic welding.

17. An electrical connector comprising:

a plurality of electrical conductors; and a frame surrounding and holding portions of the electrical conductors in a fixed array, the frame being comprised of at least two sandwiching members having a same shape which are connected to each other in a row and are alternatingly reversely positioned along the row, wherein each sandwiching member comprises conductor receiving grooves on both top and bottom surfaces, and wherein the electrical conductors extend into, through and out of the sandwiching members and are sandwiched between the sandwiching members to fixedly hold the portions of the electrical conductors.

18. A connector as in claim 17 wherein each frame member comprises first and second connecting sections which have different shapes and which are located on opposite sides of a center longitudinal conductor receiving axis of the frame member, wherein the first connecting section of one of the frame members connects to the second connecting section of another one of the frame members.

* * * * *